US006209319B1

(12) United States Patent
Maeda et al.

(10) Patent No.: US 6,209,319 B1
(45) Date of Patent: Apr. 3, 2001

(54) PIPE ASSEMBLY HAVING INNER AND OUTER PIPES

(75) Inventors: Fumihiko Maeda, Minamika wachi-machi (JP); Ryan S. Chapman, Columbus, OH (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/161,651

(22) Filed: Sep. 28, 1998

(51) Int. Cl.[7] ..... F01N 7/10

(52) U.S. Cl. ..... 60/323; 60/322; 60/272; 285/179; 138/114; 138/143

(58) Field of Search ..... 60/323, 322, 272; 285/179, 55; 138/112, 114, 143, 142

(56) References Cited

U.S. PATENT DOCUMENTS

| | | | | |
|---|---|---|---|---|
| 3,864,909 | * | 2/1975 | Kern | 60/282 |
| 4,022,019 | | 5/1977 | Garcea . | |
| 4,182,121 | | 1/1980 | Hall . | |
| 4,250,708 | * | 2/1981 | Tanahashi et al. | 60/322 |
| 4,404,992 | * | 9/1983 | Sasaki et al. | 138/140 |
| 4,621,494 | | 11/1986 | Fujita . | |
| 4,779,703 | * | 10/1988 | Takiguchi et al. | 181/228 |
| 4,796,426 | | 1/1989 | Feuling . | |
| 4,815,274 | | 3/1989 | Piatti . | |
| 5,349,817 | * | 9/1994 | Bekkering | 60/322 |
| 5,390,494 | | 2/1995 | Cleg . | |
| 5,495,873 | * | 3/1996 | Butkiewicz et al. | 138/114 |
| 5,636,515 | | 6/1997 | Matsumoto et al. . | |
| 5,655,362 | | 8/1997 | Kawajiri et al. . | |
| 5,726,397 | | 3/1998 | Mukai et al. . | |
| 5,727,386 | | 3/1998 | Watanabe et al. . | |
| 5,761,905 | | 6/1998 | Yamada et al. . | |
| 5,799,395 | | 9/1998 | Nording et al. . | |

FOREIGN PATENT DOCUMENTS 57-58330 12/1982 (JP) .

* cited by examiner

*Primary Examiner*—Thomas Denion
*Assistant Examiner*—Binh Tran
(74) *Attorney, Agent, or Firm*—Morgan & Finnegan, L.L.P.

(57) ABSTRACT

A pipe assembly includes an inner pipe and an outer laminated pipe disposed around the inner pipe for use in conveying exhaust gases from an internal combustion engine. The outer pipe is formed from two or more laminated layers to reduce noise emission. The outer pipe surrounds the inner pipe to protect the inner pipe, and muffle the inner pipe, while the inner pipe provides support for the outer pipe, either consistently contacting the outer pipe at the upstream inlet portion, or contacting the outer pipe at three areas spaced from each other on the outer pipe at the downstream outlet portion. The three contacting areas at the downstream outlet portion create an air-filled space at least partially separating the inner pipe and the outer laminated pipe. The air-filled space insulates the inner pipe so that exhaust gases moving through the inner pipe do not cool significantly as a result of heat dissipating by conduction or convection to the outer pipe. A set of such pipe assemblies can be used in an exhaust manifold of an internal combustion engine.

27 Claims, 4 Drawing Sheets

PIPE ASSEMBLY HAVING INNER AND OUTER PIPES

BACKGROUND OF THE INVENTION

1. Field of the Invention

This invention relates generally to pipes that convey exhaust gases from an internal combustion engine, and more particularly to a pipe assembly for conveying exhaust gases that includes inner and outer pipes.

2. Description of the Related Art

Some existing exhaust manifold designs include a set of single-walled pipes emanating from an internal combustion engine and connected to downstream pipes. Significant noise is generated, however, when exhaust gases are conveyed from an internal combustion engine through a set of single-walled pipes emanating from the engine.

Single-walled pipes are susceptible to thermodynamic heat loss, which impedes operation of a catalytic converter, caused by the ambient atmosphere surrounding the single-walled pipe. Single-walled pipes are also easily damaged by impact, dirt, debris and corrosive substances. Because single-walled pipes suffer from the aforementioned and other shortcomings, there have been attempts to convey exhaust gases through double-walled pipes.

For example, in U.S. Pat. No. 4,022,019 to Garcea, two outer corrugated tubes are slipped over an inner smooth tube. The outer corrugated tubes insulate the inner tube, reducing heat transfer toward the outside atmosphere.

In U.S. Pat. No. 5,390,494 to Clegg, an inner pipe is surrounded by a thicker outer pipe. Corrugations in the inner pipe provide support during bending and reduce heat dissipation to the surrounding areas.

There continues to be a need, however, for new structural arrangements that reduce engine noise emitted by exhaust gas conduits while preventing heat dissipation from the exhaust gas conduits.

SUMMARY OF THE INVENTION

According to an exemplary embodiment of the invention, a pipe assembly for conveying exhaust gases includes an inner pipe and an outer pipe disposed around the inner pipe. The outer pipe includes an outer layer and an inner layer attached, such as by lamination, to the outer layer. Noise emitted from the pipe assembly is reduced by laminating the outer layer and the inner layer and selecting the thickness of the outer layer to be twice the thickness of the inner layer. A set of such pipe assemblies can be deployed in pairs in an exhaust manifold. When paired, the planar side wall of one of the pipe assemblies is in confronting relation with the planar side wall of the other pipe assembly of the pair.

Other features and advantages of the invention will become apparent from the following detailed description, taken in conjunction with the accompanying drawings, which illustrate, by way of example, the features of the invention.

DETAILED DESCRIPTION

Figure 1:
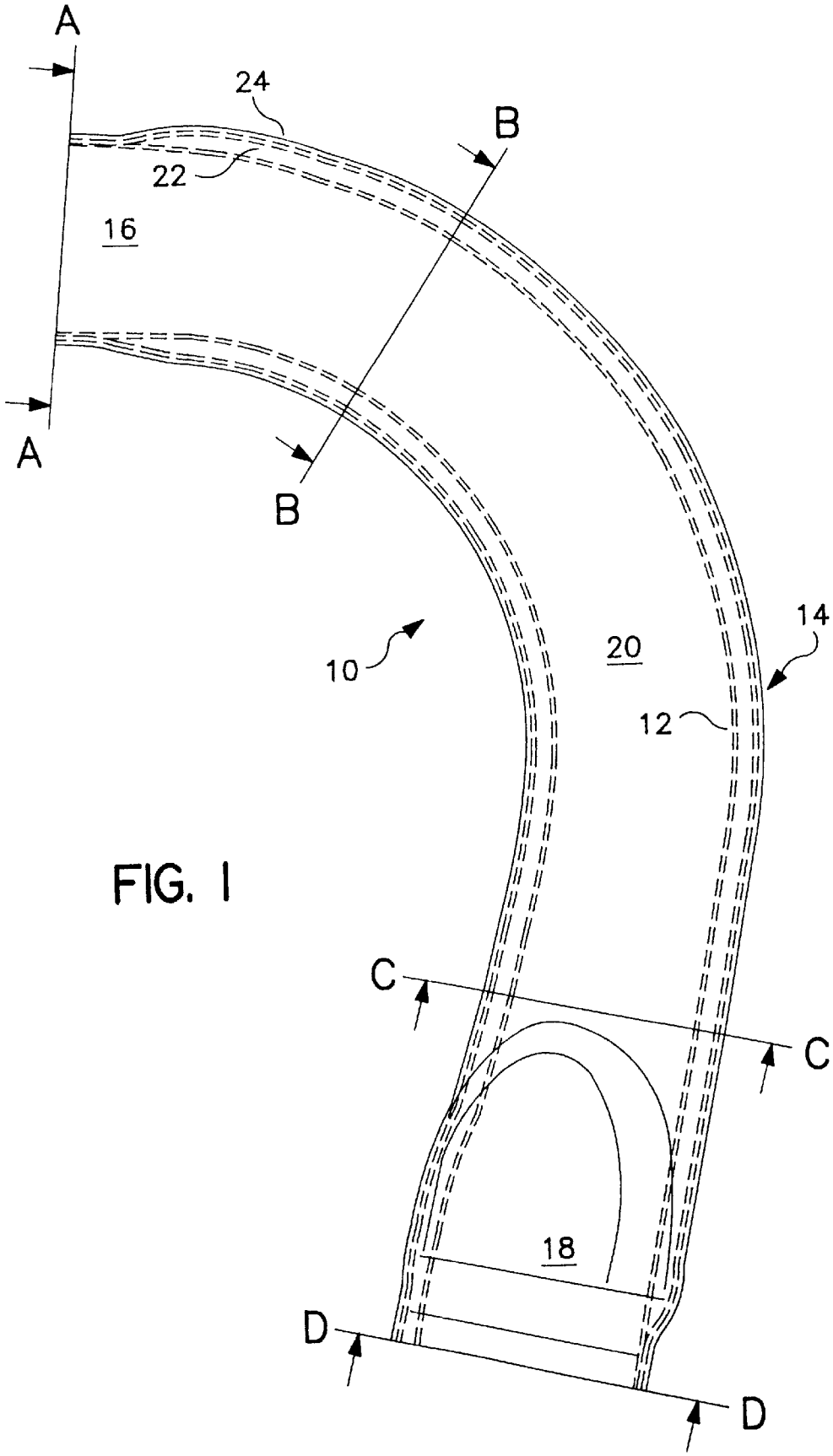
FIG. 1 is a plan sectional view of a pipe assembly in accordance with the principles of the invention.

As shown in the drawings for purposes of illustration, the invention is embodied in a pipe assembly that includes an inner pipe and an outer laminated pipe disposed around the inner pipe for use in conveying exhaust gases from an internal combustion engine. The outer pipe is formed from two or more laminated layers.

The pipe assembly has an upstream inlet portion connectable, for example, to an exhaust port of a cylinder of an internal combustion engine. A downstream outlet portion of the pipe assembly is connectable to one or more exhaust pipes.

The outer pipe surrounds the inner pipe to protect the inner pipe, and muffle the inner pipe, while the inner pipe provides support for the outer pipe, either consistently contacting the outer pipe at the upstream inlet portion, or contacting the outer pipe at three areas spaced from each other on the outer pipe at the downstream outlet portion. The three contacting areas at the downstream outlet portion create an air-filled space at least partially separating the inner pipe and the outer laminated pipe. The air-filled space insulates the inner pipe so that exhaust gas moving through the inner pipe does not cool significantly as a result of heat dissipating by conduction or convection to the outer pipe.

Because the exhaust gases remain hot in the pipe assembly, they are hotter at a catalytic converter disposed downstream of the pipe assembly. Hot exhaust gases achieve a faster light-off of the catalytic converter (i.e., attaining a sufficiently hot working temperature range) so that the catalytic converter quickly works to remove hydrocarbon and other harmful components contained in the exhaust gases. The distance separating the inner pipe and the outer laminated pipe can be adjusted to vary along the length of the pipe assembly. Such separation distance is greatest throughout a portion of the pipe assembly intermediate the upstream inlet portion and the downstream outlet portion, where thermal insulation of the inner pipe is greatest. These and other features of the preferred embodiments of the invention will become more fully apparent with reference to the drawings.

FIG. 1 shows a plan sectional view of a pipe assembly 10 having an inner pipe 12 and an outer pipe 14 in accordance with the principles of the invention. Referring to FIG. 1, the pipe assembly 10 generally has a curvilinear shape which is based on the need to connect a particular cylinder at one position and orientation to an exhaust pipe at another position and orientation. The pipe assembly 10 shown in FIG. 1 includes an upstream inlet portion 16, a downstream outlet portion 18 and a portion 20 intermediate the upstream inlet portion and the downstream outlet portion.

The upstream inlet portion 16 of the pipe assembly has a "race-track" cross-sectional configuration, as illustrated in and subsequently described with reference to FIG. 2, that can be registered with, or friction-fit within, a similarly shaped inlet opening defined by an inlet flange mountable on an internal combustion engine. At the upstream inlet portion 16 of the pipe assembly, the inner pipe 12 is welded to uniformly contact the surrounding outer pipe 14. Such "race-track" cross-sectional configuration is the shape presented by a rectangle that has each of its two short sides replaced by the arc of a semi-circle (or another kind of curved arc). A "race-track" cross-sectional configuration also includes an oval shape, an elliptical shape, or an oblong shape.

At a first lengthwise position intermediate the upstream inlet portion 16 and the downstream outlet portion 18, the pipe assembly 10 presents a substantially circular cross-sectional configuration, as illustrated in and subsequently described with reference to FIG. 3. Along the length of the pipe assembly, within such first lengthwise position of such intermediate portion 20, the inner pipe 12 is separated from the outer pipe 14 to reduce heat conduction and/or convection to the outer pipe. Further downstream, at a second lengthwise position intermediate the upstream inlet portion 16 and the downstream outlet portion 18, the cross-sectional configuration of the pipe assembly 10 changes to a race-track cross-sectional configuration, as illustrated in and subsequently described with reference to FIG. 4, at which point the outer pipe 14 and the inner pipe 12 remain separated by a preselected distance to reduce heat dissipation to the outer pipe. The separation distance can be adjusted based on thermal insulation and/or noise elimination requirements.

The downstream outlet portion 18 of the pipe assembly 10 has a substantially "D-shaped" cross-sectional configuration (i.e., the shape presented by a straight line connecting the ends of the arc of a semi-circle or another curved shape), as illustrated in and subsequently described with reference to FIG. 5. Both the outer laminated pipe 14, and the inner pipe 12 disposed within the outer laminated pipe 14, present such a D-shaped cross-sectional configuration at the downstream outlet portion 18 of the pipe assembly 10.

Figure 6:
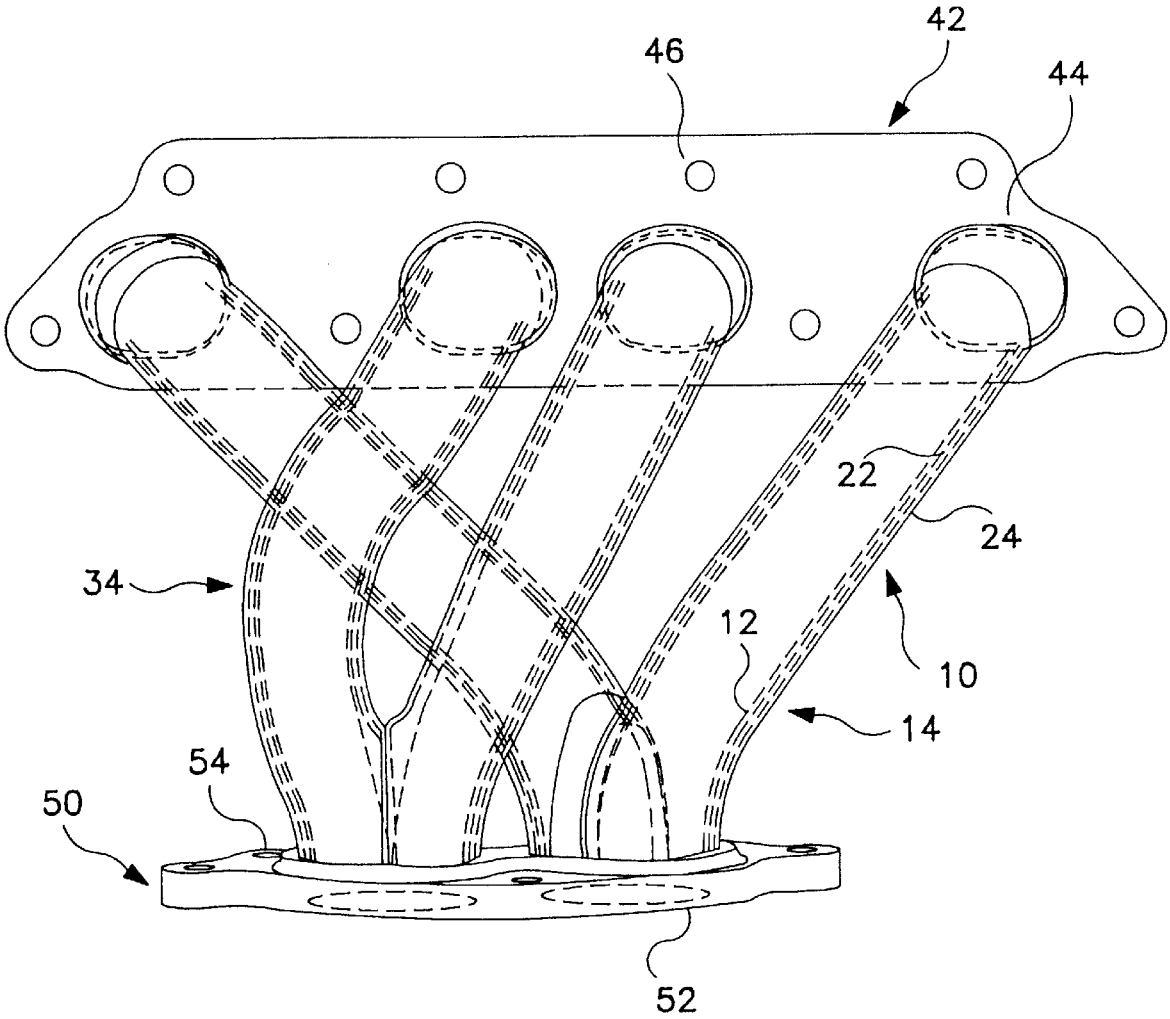
FIG. 6 is a perspective view of an exhaust manifold in accordance with the principles of the invention.

According to the principles of the invention, a pipe assembly can be paired with another pipe assembly in an exhaust manifold by attaching (e.g., by welding) the downstream outlet portions of the pipe assemblies, as illustrated in FIG. 6. When two pipe assemblies are attached at their downstream outlet portions, the pipe members present a combined cross-sectional configuration that will fit into an outlet opening that has a substantially circular cross-sectional configuration. The outer laminated pipe 14 of the pipe assembly presents a substantially planar side wall along the downstream outlet portion 18. In combination, the planar side wall of one outer laminated pipe is in confronting relation with the planar side wall of the other outer laminated pipe of the pair.

According to the specific embodiment illustrated in FIG. 1, the outer pipe of the pipe assembly is formed of an inner layer 22 and an outer layer 24 to reduce noise emitted from the pipe assembly 10 in accordance with the principles of the invention. The inner layer 22 is preferably laminated to the outer layer 24. The respective thicknesses of the inner layer 22 and the outer layer 24 are selected in relation to and based upon each other to achieve optimum noise reduction. The thickness of the outer layer 24 of the outer pipe 14 is preferably selected to be double that of the inner layer 22 of the outer pipe. Experimental testing has shown that this thickness relationship between the inner and outer layers 22, 24 of the outer pipe 14 produces the optimum reduction of noise.

In the preferred embodiment of the invention, the pipes are made from austenitic stainless steel. However, any other suitable material such as just stainless steel or steel can also be used. The thickness of the outer layer 24 is substantially equal to 0.8 mm and the thickness of the inner layer 22 is substantially equal to 0.4 mm. The inner pipe 12 has a thickness substantially equal to 0.6 mm. It has been found that this thickness relationship between the inner layer 22 and the outer layer 24 provides the best noise reduction.

Vibrations from the operating engine, along with continual heating and cooling, can cause engine exhaust gas conduits to crack. Accordingly, the invention contemplates that other thickness relationships between the inner layer 22 of the outer pipe and the outer layer 24 of the outer pipe can be employed, and that a relatively thicker inner layer 22 can be used so that possibly vibrations and other effects of engine operation do not cause the thin inner layer 22 of the outer pipe to crack from the vibratory stresses.

For example, in another specific embodiment, the inner pipe 12 can have a thickness of 0.6 mm, the inner layer 22 of the outer pipe can have a thickness of 0.6 mm and the outer layer 24 can have a thickness of 0.8 mm. The 0.6 mm-thick inner layer 22 in this specific embodiment of the invention is probably less prone to cracking and can give additional endurance to the pipe assembly.

Figure 2:
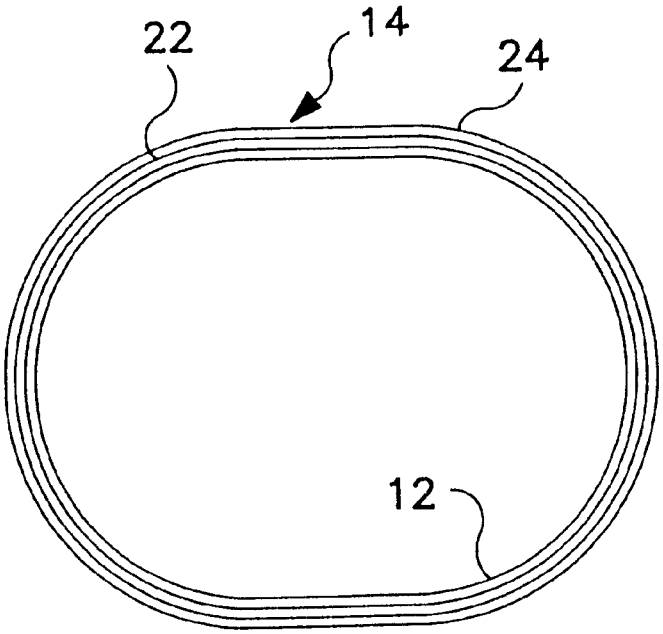
FIG. 2 is a cross-sectional view taken along the line A—A in FIG. 1.

FIG. 2 is a cross-sectional view of the upstream inlet portion of the pipe assembly 10 taken along the line A—A in FIG. 1. With reference to FIG. 2, the inner pipe 12 and the outer laminated pipe 14 are welded to each other. The inner pipe 12 and the outer laminated pipe 14 each have a race-track cross-sectional configuration. As shown in FIG. 2, the inner pipe 12 and the outer laminated pipe 14 are in substantially contacting relationship at the upstream inlet portion 16 (FIG. 1) for mutual support.

Figure 3:
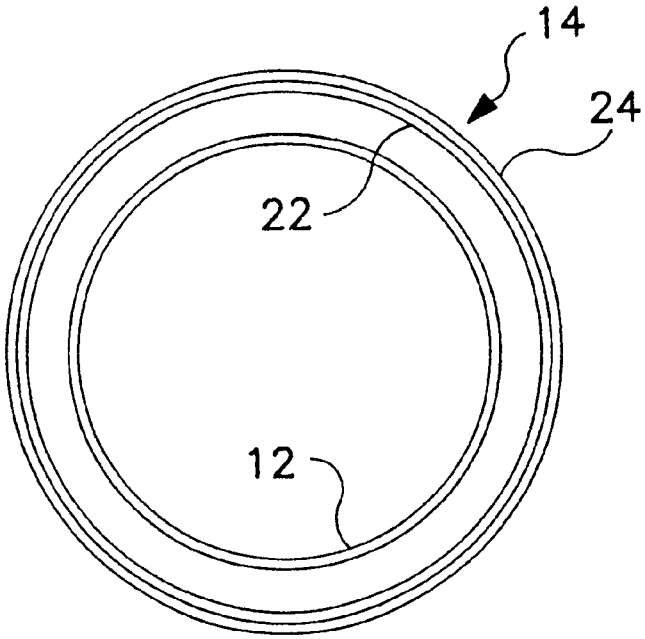
FIG. 3 is a cross-sectional view taken along the line B—B in FIG. 1.

FIG. 3 is a cross-sectional view of the pipe assembly 10 taken along the line B—B in FIG. 1, at a lengthwise position further downstream along the length of the pipe assembly from the upstream inlet portion illustrated in FIG. 2. With reference to FIG. 3, the inner pipe 12 and the outer pipe 14 are shown in substantially spaced relation to reduce thermal dissipation so that quicker light-off of a catalytic converter can be accomplished. At the lengthwise position depicted in FIG. 3, the inner pipe 12 and the outer laminated pipe 14 each present a substantially circular cross-sectional configuration and are spaced from each other by a predetermined separation distance, which is measured radially outward from the outer surface of the inner pipe 12 to the inner surface of the inner layer 22.

Figure 4:
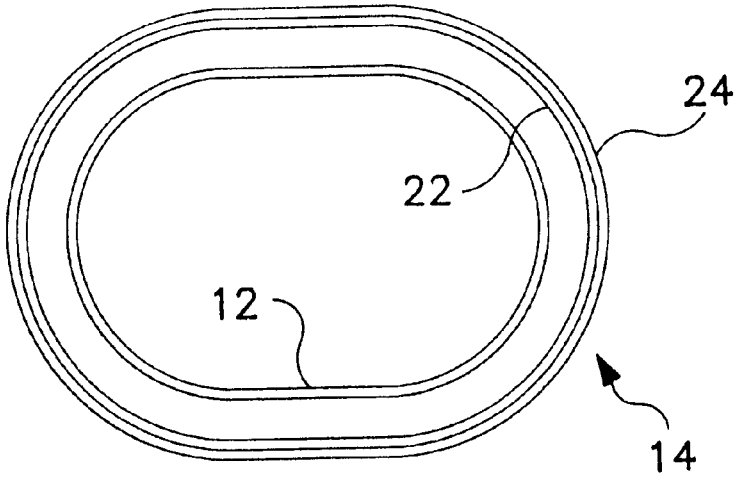
FIG. 4 is a cross-sectional view taken along the line C—C in FIG. 1.

FIG. 4 is a cross-sectional view of the pipe assembly 10 taken along the line C—C in FIG. 1, at a lengthwise position further downstream from the lengthwise position depicted in FIG. 3. With reference to FIG. 4, the inner pipe 12 and the outer laminated pipe 14 both present a race track cross-sectional configuration. At this position, the inner pipe 12 and the outer laminated pipe 14 are in substantially spaced relation to reduce thermal dissipation to the outer pipe 14. The outer pipe 14 is displaced radially outward from the inner pipe 12 by a separation distance measured from the outer surface of the inner pipe 12 to the inner surface of the inner layer 22.

Figure 5:
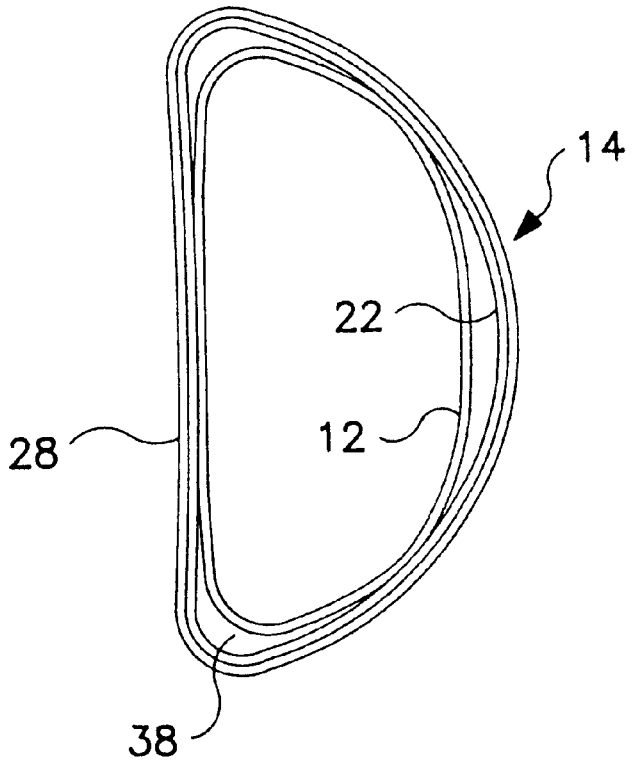
FIG. 5 is a cross-sectional view taken along the line D—D in FIG. 1.

FIG. 5 is a cross-sectional view of the downstream outlet portion of the pipe assembly 10 taken along the line D—D in FIG. 1. With reference to FIG. 5, the downstream outlet portion of the pipe assembly presents a substantially D-shaped cross-sectional configuration. Both the inner pipe 12 and the outer laminated pipe 14 present such a D-shaped configuration at the downstream outlet portion. The inner pipe 12 and the outer laminated pipe 14 are in contact according to the principles of the invention at three areas, as shown in FIG. 5, to optimally support the outer pipe 14. The outer laminated pipe 14 presents a substantially planar side wall 28 at the downstream outlet portion 18 (FIG. 1). A pair of such pipe assemblies, having their planar side walls positioned adjacent to each other, can fit through the circular opening of an outlet flange.

At the upstream inlet portion 16 (FIG. 1) of the pipe assembly 10, the inner pipe 12 consistently contacts the surrounding outer laminated pipe 14, as shown in FIG. 2. At the downstream outlet portion 18 of the pipe assembly 10, the inner pipe 12 abuts the inner layer 22 of the outer pipe 14 at three contacting areas spaced from each other on the outer pipe 14 to optimally stabilize the pipes, as shown in FIG. 5. The arrangement shown in FIG. 5 provides thermal insulation of the inner pipe 12 by way of an air-filled space 38 at least partially separating the inner pipe 12 and the outer pipe 14.

By way of example and not limitation, the pipe assembly is subsequently described as embodied in an exhaust manifold illustrated in FIG. 6 according to a specific embodiment of the invention. The exhaust manifold shown in FIG. 6 includes a set 34 of pipe assemblies connecting the cylinders of an internal combustion engine (not shown) to exhaust pipes (not shown) located downstream from the cylinders. Each pipe assembly 10 includes an outer pipe 14 and an inner pipe 12 located within and surrounded by the outer pipe 14. The outer pipe 14 includes an outer layer 24 and an inner layer 22, where the inner layer 22 is attached to the outer layer 24, preferably laminated; and the outer layer 24 has a thickness selected in relation to and based upon the thickness of the inner layer 22 to optimally reduce noise emitted from the set 34 of pipe assemblies according to the specific embodiment of the invention. The outer layer 24 of the outer pipe 14 is preferably approximately twice the thickness of the inner layer 22 of the outer pipe 14. For example, the outer layer 24 of the outer pipe 14 has a thickness of 0.8 mm while the inner layer 22 of the outer pipe 14 has a thickness of 0.4 mm. The outer layer 24 and the inner layer 22 each present a smooth surface to facilitate lamination thereof.

The exhaust manifold shown in FIG. 6 includes an inlet flange 42 which is mountable on an internal combustion engine. The inlet flange 42 defines a group of inlet openings 44 which when the inlet flange 42 is mounted to the internal combustion engine correspond to the location of exhaust ports of cylinders of the internal combustion engine, and through which exhaust gases can move. Each inlet opening 44 is associated with a respective exhaust port.

The inlet flange 42 defines one or more bolt holes 46 through which a bolt or other fastening means can extend to fasten the inlet flange 42 to the internal combustion engine so that the inlet openings 44 of the inlet flange 42 are aligned with the exhaust ports of the internal combustion engine.

Four inlet openings 44 are illustrated in FIG. 6. In the exhaust manifold shown in FIG. 6, each of the four pipe assemblies, such as pipe assembly 10, is connected at its upstream inlet portion to one of the four inlet openings 44 in the inlet flange 42 so that exhaust gases can pass from the respective exhaust port, through the respective inlet opening into the upstream inlet portion of such pipe assembly 10.

Each of the pipe assemblies is connected at its downstream outlet portion to an outlet flange 50. The outlet flange 50 is connectable to a number of downstream pipes. The outlet flange 50 defines a plurality of outlet openings 52. The number of outlet openings 52 in the outlet flange 50 is half the number of pipe assemblies according to the specific embodiment of the invention illustrated in FIG. 6. The outlet openings 52 defined by the outlet flange 50 connect pairs of pipe assemblies to an associated downstream pipe, and provide a conduit through which exhaust gases can move from the pipe assemblies to the downstream pipes. The outlet flange 50 defines one or more bolt holes 54 through which a bolt or other fastening means can pass to fasten and align the outlet flange to the downstream pipes.

From the foregoing, it will be appreciated that noise emitted from the pipe assemblies is reduced according to the principles of the invention by laminating the outer layer and the inner layer of the outer pipe and selecting the respective thicknesses of the outer layer and the inner layer in relation to each other.

While several particular forms of the invention have been illustrated and described, it will also be apparent that various modifications can be made without departing from the spirit and scope of the invention.

What is claimed is:

1. A pipe assembly for conveying exhaust gases from an internal combustion engine, the pipe assembly having an inlet end and an outlet end, comprising:

an inner pipe;

an outer pipe disposed around the inner pipe; and an air-filled space at least partially separating the inner pipe and the outer pipe and extending between a first flange connected to the engine at the inlet end and a second flange connected to the outlet end;

wherein the outer pipe includes an outer layer, and an inner layer attached to the outer layer.

2. The pipe assembly of claim 1, wherein:

the outer layer and the inner layer are laminated to each other.

3. The pipe assembly of claim 1, wherein:

the thickness of the outer layer is approximately twice the thickness of the inner layer.

4. The pipe assembly of claim 1, wherein:

the outer layer has a thickness substantially equal to 0.8 mm and the inner layer has a thickness substantially equal to 0.4 mm.

5. The pipe assembly of claim 1, wherein:

the inner pipe has a thickness substantially equal to 0.6 mm.

6. The pipe assembly of claim 1, wherein:

at least part of the inner pipe abuts the inner layer of the outer pipe.

7. The pipe assembly of claim 1, wherein:

the inner pipe abuts the inner layer of the outer pipe at three contacting areas that are spaced from each other on the outer pipe.

8. The pipe assembly of claim 1, wherein:

both the outer layer of the outer pipe and the inner layer of the outer pipe present smooth surfaces.

9. The pipe assembly of claim 1, wherein:

the inner layer and the outer layer have respective thicknesses selected in relation to each other to reduce noise emissions.

10. A method for reducing noise emitted from a pipe assembly conveying exhaust gases from an internal combustion engine, the pipe assembly having an inlet end and an outlet end, the pipe assembly including an inner pipe, an outer pipe disposed around the inner pipe, and a separation distance at least partially separating the inner pipe and the outer pipe and extending between a first flange connected to the engine at the inlet end and a second flange connected to the outlet end, the method comprising the steps of:

laminating an outer layer and an inner layer to make the outer pipe; and selecting the respective thicknesses of the outer layer and the inner layer such that the thickness of the outer layer is approximately twice the thickness of the inner layer.

11. The method of claim 10, further comprising the step of:

adjusting the separation distance between the inner pipe and the outer pipe at a portion of the pipe assembly.

12. The method of claim 10, further comprising the step of:

varying the separation distance between the inner pipe and the outer pipe along the pipe assembly.

13. The method of claim 10, further comprising the step of:

connecting an upstream inlet portion of the pipe assembly to an exhaust port of an internal combustion engine.

14. The method of claim 13, further comprising the step of:

receiving exhaust gases in the pipe assembly.

15. The method of claim 10, wherein:

a downstream outlet portion of the pipe assembly presents a D-shaped cross-sectional configuration.

16. An exhaust manifold for conveying exhaust gases from an engine, comprising:

a first pipe assembly including a first inner pipe and a first outer pipe disposed around the first inner pipe, the first outer pipe being made from at least two laminated layers, a second pipe assembly including a second inner pipe and a second outer pipe disposed around the second inner pipe, the second outer pipe being made from at least two laminated layers; each pipe assembly having an inlet end and an outlet end;

the first pipe assembly presenting a substantially planar first side wall at a first downstream outlet portion thereof;

the second pipe assembly presenting a substantially planar second side wall at a second downstream outlet portion thereof;

an air-filled space at least partially separating the inner pipe and the outer pipe and extending between a first flange connected to the engine at the inlet end and a second flange connected to the outlet end, and wherein the first side wall is in confronting relation with the second side wall.

17. The exhaust manifold of claim 16, wherein:

each of the first downstream outlet portion and the second downstream outlet portion presents a D-shaped cross-sectional configuration.

18. The exhaust manifold of claim 16, wherein:

the first downstream outlet portion and the second downstream outlet portion present a combined cross-sectional configuration that fits into an outlet opening having a substantially circular cross-sectional configuration.

19. The exhaust manifold of claim 16, wherein:

the first outer pipe includes a first outer layer laminated to a first inner layer; and the second outer pipe includes a second outer layer laminated to a second inner layer.

20. The exhaust manifold of claim 19, wherein:

the thickness of the first outer layer is approximately twice the thickness of the first inner layer; and the thickness of the second outer layer is approximately twice the thickness of the second inner layer.

21. The exhaust manifold of claim 19, wherein:

each of the first outer layer and the second outer layer has a thickness substantially equal to 0.8 mm; and each of the first inner layer and the second inner layer has a thickness substantially equal to 0.4 mm.

22. The exhaust manifold of claim 16, wherein:

each of the first inner pipe and the second inner pipe has a thickness substantially equal to 0.6 mm.

23. A pipe assembly for conveying exhaust gases from an internal combustion engine, the pipe assembly having an inlet end and an outlet end, comprising:

an inner pipe;

means, disposed around the inner pipe, for reducing noise emitted from the pipe assembly; and an air-filled space at least partially separating the inner pipe and the means for reducing noise and extending between a first flange connected to the engine at the inlet end and a second flange connected to the outlet end.

24. The pipe assembly of claim 23, further comprising:

means, at least partially separating the means for reducing noise and the inner pipe, for thermally insulating the inner pipe.

25. The pipe assembly of claim 23, wherein:

the means for reducing noise prevents heat dissipation from the pipe assembly.

26. The pipe assembly of claim 23, wherein:

the means for reducing noise includes an inner layer, and an outer layer laminated to the inner layer.

27. The pipe assembly of claim 26, wherein:

the thickness of the outer layer is approximately twice the thickness of the inner layer.

* * * * *